US011292986B2

(12) United States Patent
Diesendruck

(10) Patent No.: US 11,292,986 B2
(45) Date of Patent: Apr. 5, 2022

(54) MECHANOCHEMICAL RESISTANT INTRAMOLECULAR CROSSLINKED POLYMERS AND USES THEREOF

(71) Applicant: Technion Research & Development Foundation Limited, Haifa (IL)

(72) Inventor: Charles Eliezer Diesendruck, Binyamina-Giv'at Ada (IL)

(73) Assignee: Technion Research & Development Foundation Limited, Haifa (IL)

( * ) Notice: Subject to any disclaimer, the term of this patent is extended or adjusted under 35 U.S.C. 154(b) by 703 days.

(21) Appl. No.: 16/074,090

(22) PCT Filed: Jan. 29, 2017

(86) PCT No.: PCT/IL2017/050101
§ 371 (c)(1),
(2) Date: Jul. 31, 2018

(87) PCT Pub. No.: WO2017/134652
PCT Pub. Date: Aug. 10, 2017

(65) Prior Publication Data

US 2021/0102138 A1 Apr. 8, 2021

(30) Foreign Application Priority Data

Feb. 1, 2016 (IL) ..... 243901

(51) Int. Cl.

| | |
|---|---|
| ***C10M 145/14*** | (2006.01) |
| *C10N 30/00* | (2006.01) |
| *C10N 30/02* | (2006.01) |
| *C10N 60/00* | (2006.01) |

(52) U.S. Cl.
CPC .... *C10M 145/14* (2013.01); *C10M 2209/084* (2013.01); *C10N 2030/02* (2013.01); *C10N 2030/68* (2020.05); *C10N 2060/00* (2013.01)

(58) Field of Classification Search
CPC ..... C08J 3/24; C10M 161/00; C10M 145/14; C10M 2209/084; C10N 2060/00; C10N 2030/68; C10N 2030/02; C08F 8/32; C08G 75/12
See application file for complete search history.

(56) References Cited

U.S. PATENT DOCUMENTS

2013/0310291 A1 11/2013 Baum et al.
2016/0355622 A1* 12/2016 Ichino ..... C08F 210/18

OTHER PUBLICATIONS

Beck, J. B., et al. "Facile preparation of nanoparticles by intramolecular cross-linking of isocyanate functionalized copolymers". Macromolecules, 2009, 42(15) pp. 5629-5635.
Whitaker D. et al. "Thermoresponsive Dynamic Covalent Single-Chain Polymer Nanoparticles Reversibly Transform into a Hydrogel", Angewandte Chemie, International Edition, De, 2013, 52(3) pp. 956-959.
European Search Report issued for EP17747107.5 dated May 24, 2019.

(Continued)

*Primary Examiner* — Vishal V Vasisth

(57) ABSTRACT

This invention is directed to intramolecular crosslinked polymer chains, commonly known also as single-chain polymer nanoparticles (SCPNs), with high resistance to mechanochemical bond scission and to uses thereof in solution.

42 Claims, 5 Drawing Sheets

(56) References Cited

OTHER PUBLICATIONS

Harth, E. et al. "A facile approach to architecturally defined nanoparticles via intramolecular chain collapse" Journal of the American Chemical Society, 2002, 124(29), pp. 8653-8660.
International Search Report issued for PCT application No. PCT/IL2017/050101 dated Apr. 5, 2017.
Kaitz, J. A et al. "Depolymerizable, adaptive supramolecular polymer nanoparticles and networks" Polymer Chemistry, 2014, 5(12) pp. 3788-3794.
Mavila, S. et al. "Polycyclooctadiene complexes of rhodium (I): direct access to organometallic nanoparticles" Angewandte Chemie International Edition, 2013 52(22) pp. 5767-5770.
Mavila, S. et al. "Intramolecular cross-linking methodologies for the synthesis of polymer nanoparticles" Chemical reviews, 2015, 116(3) pp. 878-961.
MacKay M. et al. "Nanoscale effects leading to non Einstein-like decrease in viscosity". Nature materials, Nov. 2003. 2(11), pp. 762-766.
Morgan, S. et al. "Higher-molecular-weight hyperbranched X polyethylenes containing crosslinking structures as lubricant viscosity-index improvers" Polymer Engineering & Science, 2010(5) pp. 911-918.
Murray, B. S. et al. (2011). "Dynamic covalent single-chain polymer nanoparticles" Macromolecules, 44(18), pp. 7242-7252.
Sanchez-Sanchez A., et al. "nanocarriers mimicking transient-binding disordered proteins" ACS Macro Letters, 2013, 2(6) pp. 491-495.
Sanchez-Sanchez A. et al. "Design and Preparation of Single-Chain Nanocarriers Mimicking Disordered Proteins for Combined Delivery of Dermal Bioactive Cargos", Macromolecular Rapid Communications 2013, (34) pp. 1681-1685.
Sijbesma, R. P et al. "Reversible polymers formed from self-complementary monomers using quadruple hydrogen bonding" Science, 1997, 278(5343) pp. 1601-1604.
Staudinger H. et al. Über Isopren und Kautschuk, 19. Mitteil.: "Über die Molekülgröße des Kautschuks und der Balata. Berichte der deutschen chemischen" Gesellschaft (A and B Series), 1930, 63(3) pp. 734-736. English abstract.
Tuteja A. et al. "Molecular architecture and rheological characterization of novel intramolecularly crosslinked polystyrene nanoparticles", Journal of Polymer Science Part B: Polymer Physics, 2006, 44(14) pp. 1930-1947.
Tuten B. et al. "Single-chain polymer nanoparticles via reversible disulfide bridges" Polymer Chemistry, 2012, 3(11), pp. 3068-3071.
Communication Pursuant to Article 94(3) EPC dated Jun. 10, 2020 From the European Patent Office Re. Application No. 17747107.5. (5 Pages).
Supplementary European Search Report and the European Search Opinion dated May 24, 2019 From the European Patent Office Re. Application No. 17747107.5.(8 Pages).

* cited by examiner

MECHANOCHEMICAL RESISTANT INTRAMOLECULAR CROSSLINKED POLYMERS AND USES THEREOF

CROSS-REFERENCE TO RELATED APPLICATIONS

This application is a National Phase Application of PCT International Application No. PCT/IL2017/050101, International Filing Date Jan. 29, 2017, claiming priority from Israel Patent Application No 243901, filed Feb. 1, 2016, which is hereby incorporated by reference in its entirely.

FIELD OF THE INVENTION

This invention is directed to intramolecular crosslinked polymer chains, commonly known also as single-chain polymer nanoparticles (SCPNs), with high resistance to mechanochemical bond scission and to uses thereof in solution.

BACKGROUND OF THE INVENTION

Intramolecular crosslinked polymer chains, commonly known also as single-chain polymer nanoparticles (SCPNs), or as single-chain collapse, adapt their physical and mechanical properties according to their nanomechanical environment. Internally crosslinked polymer is a linear polymer that contains internal chemical bonds, or internal cross-linker, crosslinking the polymer at various positions along the chain. (FIG. 1). Intramolecular crosslinked polymer chains offer more tunable variables and properties such as the amount and positioning of crosslinks. Numerous methods for the preparation of soluble intramolecular crosslinked polymer chains have been described. [Sudheendran Mavila, Or Eivgi, Inbal Berkovich, and N. Gabriel Lemcoff; "Intramolecular Cross-Linking Methodologies for the Synthesis of Polymer Nanoparticles", *Chemical Reviews*, DOI: 10.1021/acs.chemrev.5b00290] A vast majority of the crosslinking strategies developed for single-chain collapse falls in the category of covalent chemistry. Among them, click chemistry, radical coupling, benzocyclobutane dimerization, Bergmann cyclization, Diels/Alder ligation, etc., are frequently used.

Polymeric materials are affected by mechanical stress, where mechanical energy is transduced into chemical energy in polymeric materials via scission of covalent bonds. This process is called mechanochemistry. In the 1930s, Staudinger (Staudinger, H.; Bondy, H. F. On isoprene and caoutchuc, 19. Announcement: On the molecular size of caoutchuc and Balata. *Ber Dtsch Chem Ges* 1930, 63, 734-736) demonstrated that mechanically shearing polymeric materials led to a decrease in molecular weight (MW) as a result of chain scission reactions. Later studies revealed that when mechanical force is applied to polymers, force is maximized at the center of the chains in dilute polymer solutions or midway between covalent or non-covalent crosslinks (entanglements) in the solid state. These studies also revealed important physical and kinetic parameters to these bond scission reactions: there exist limiting molecular weights ($M_{lim}$) below which not enough energy accumulates for bond scission to occur; above the $M_{lim}$, the rate of mechanochemical degradation in solution is proportional to the degree of polymerization of the chain, but in the solid state this rate is almost unchangeable. 50 years later, Encina et al. demonstrated that the presence of weaker chemical bonds in the part of the chain in which mechanical forces accumulate leads to increased scission rates and selective scission reactions. Mechanochemical bond scission is not proportional to molecular weight, but to the degree of polymerization. Polymer side chains do not significantly affect mechanochemical scission as long as they are shorter than the main chain, but they affect the intrinsic viscosity of the polymer. For many years now, the industry has been using hyperbranched polymers or block copolymer micelles as viscosity modifiers, allowing higher molecular weight, but maintaining the length of the main chain shorter. However, depending on branch length and density, these polymers can be more susceptive to mechanical forces.

Understanding the affect of mechanical stress on polymers is central for developing novel and robust materials with extended lifetimes.

SUMMARY OF THE INVENTION

In one embodiment, this invention is directed to a lubricating composition comprising an intramolecular crosslinked polymer. In another embodiment the intramolecular crosslinked polymer comprises between 0.1 mol % and 30 mol % of crosslinkers.

In one embodiment, this invention is directed to a method of stabilizing a lubricant composition comprising adding an intramolecular crosslinked polymer as an additive. In another embodiment the intramolecular crosslinked polymer comprises between 0.1 mol % and 30 mol % of crosslinkers. In another embodiment, the additive is a viscosity modifier or a pour point depressant.

In one embodiment, the intramolecular crosslinked polymers having resistance to mechanical stress in a liquid is used as a drag reducing agent, reducing turbulence in flow of a liquid.

In one embodiment, this invention is directed to a method of reducing turbulence in flow of a liquid comprising adding to said liquid an intramolecular crosslinked polymer. In another embodiment, the liquid is water, oil, or petroleum. In another embodiment the intramolecular crosslinked polymer comprises between 0.1 mol % and 30 mol % of crosslinkers.

In one embodiment, the invention provides a method of preparing a lubricant composition, comprising the steps of: synthesis of intramolecular crosslinked polymer and adding said intramolecular crosslinked polymer to a lubricant.

In another embodiment, the intramolecular crosslinked polymer is prepared by (i) synthesis of linear chain polymer precursor from monomers; and (ii) crosslinking the linear chain polymer precursor to afford an intramolecular crosslinked polymer. In another embodiment, the intramolecular crosslinked polymer is prepared in one step.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
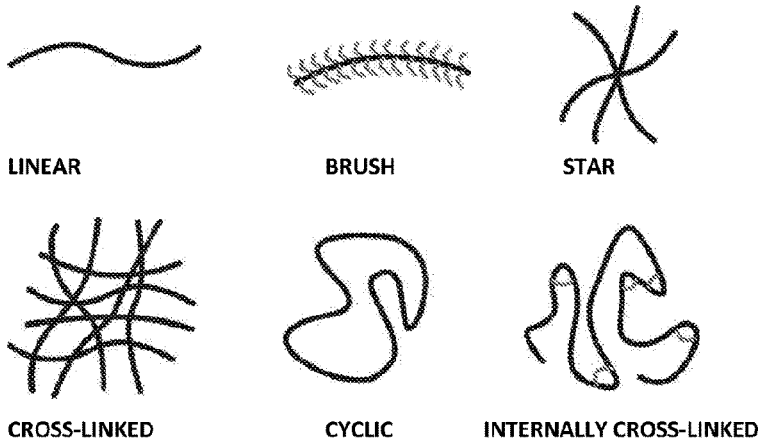
FIG. 1 presents schematic illustration of different polymer architectures, including intramolecular cross linked polymers.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

This invention is directed to intramolecular crosslinked polymer chains, commonly known also as single-chain polymer nanoparticles (SCPNs), or as single-chain collapse with high resistance to mechanochemical bond scission and to uses thereof.

Applied mechanical force/stress on intramolecular cross-linked polymers results on bond scission events in the internal cross-linkers first, which are not in the main chain of the polymer (as in linear polymers) and therefore, do not influence significantly on the properties of the polymers but are the first to be broken in case of mechanical stress, keeping the main chain intact.

Figure 2:
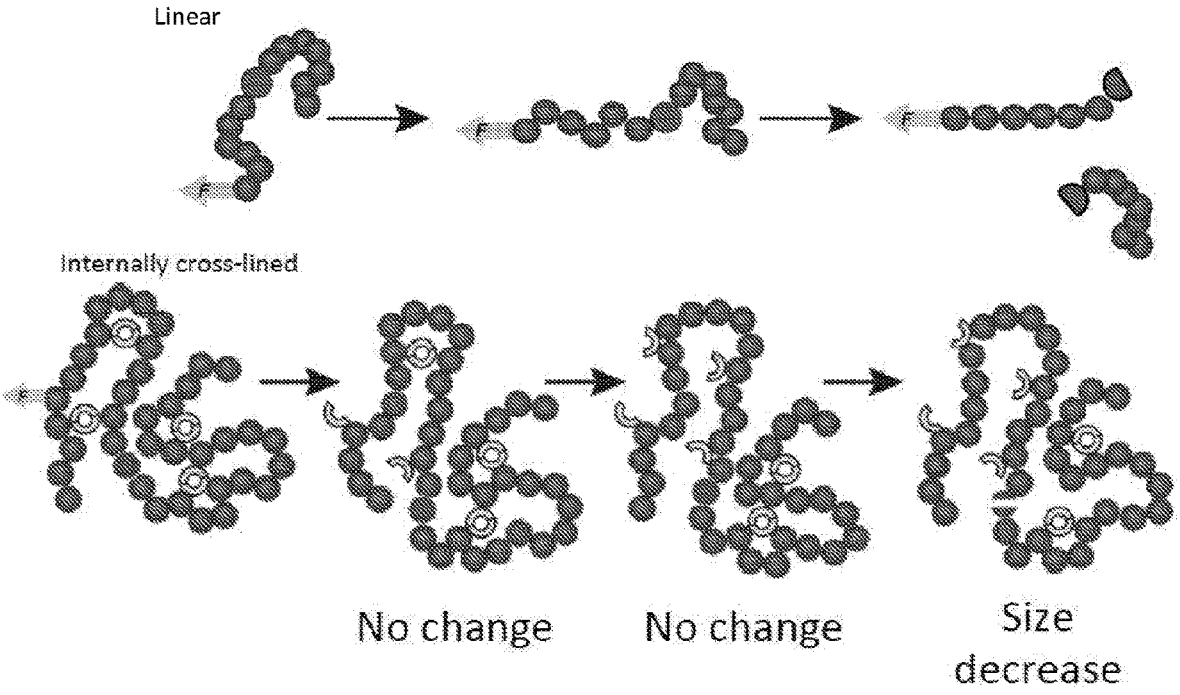
FIG. 2 presents change in size of a linear polymer (up) and an intramolecular cross linked polymer (down) as a function of number of bond scission events.

In one embodiment, FIG. 2 shows bond scission in linear and internally crosslinked polymers. Unfolding of polymer chains as force is applied, leading to a chemical bond scission event. In a linear chain, as previously studied, force is maximized at the center of the chain, where half of the polymer serves as an anchor. If there is an internal crosslink, the force applied is divided between the two possible pathways, and due to the limitation in the unfolding, will be maximized in the shortest crosslink, leading to a scission event before the force reaches the center of the chain. Accordingly, incorporation of the cross linkers/bonds in polymers improve the mechanical stability of polymers.

The term "cross-link" or "cross linker" in this invention refers to define an additional bond or linking unit between monomers of the same chain (i.e. intramolecular crossed linked polymer). This is as opposed to cross linked polymer, wherein a bond binds two or more different polymer chains. FIG. 1 illustrates the differences between "cross-linked" and "intramolecular cross-linked" polymers. Thus, an intramolecular cross-link is always a type of ring-closing reaction, while the more classical cross-linking processes produce undefined thermoset polymers.

Thus, intramolecular cross linked polymers or single-chain polymer nanoparticles (SCPNs) are linear polymers that contain internal chemical bonds crosslinking the polymer at various positions along the chain. While easier to prepare compared to cyclic polymer, SCPNs offer more tunable variables and properties such as the amount and positioning of crosslinks. Numerous methods for the preparation of soluble SCPNs have been described: (i) Sudheendran Mavila, Or Eivgi, Inbal Berkovich, and N. Gabriel Lemcoff; "Intramolecular Cross-Linking Methodologies for the Synthesis of Polymer Nanoparticles", *Chemical Reviews*, DOI: 10.1021/acs.chemrev.5b00290; (ii) Sijbesma, R. P.; Beijer, F. H.; Brunsveld, L.; Folmer, B. J. B.; Hirschberg, J. H. K. K.; Lange, R. F. M.; Lowe, J. K. L.; Meijer, E. W. Reversible Polymers Formed from Self-Complementary Monomers Using Quadruple Hydrogen Bonding. *Science* 1997, 278, 1601-1604; (iii) Mavila, S.; Diesendruck, C. E.; Linde, S.; Amir, L.; Shikler, R.; Lemcoff, N. G. Polycyclooctadiene Complexes of Rhodium (I): Direct Access to Organometallic Nanoparticles. *Angew Chem Int Ed* 2013, 52, 5767-5770; (iv) Tuten, B. T.; Chao, D. M.; Lyon, C. K.; Berda, E. B. Single-chain polymer nanoparticles via reversible disulfide bridges. *Polym Chem-Uk* 2012, 3, 3068-3071; (v) Murray, B. S.; Fulton, D. A. Dynamic Covalent Single-Chain Polymer Nanoparticles. *Macromolecules* 2011, 44, 7242-7252; (vi) Harth, E.; Van Horn, B.; Lee, V. Y.; Germack, D. S.; Gonzales, C. P.; Miller, R. D.; Hawker, C. J. A facile approach to architecturally defined nanoparticles via intramolecular chain collapse. *Journal of the American Chemical Society* 2002, 124, 8653-8660; (vi) Beck, J. B.; Killops, K. L.; Kang, T.; Sivanandan, K.; Bayles, A.; Mackay, M. E.; Wooley, K. L.; Hawker, C. J. Facile Preparation of Nanoparticles by Intramolecular Cross-Linking of Isocyanate Functionalized Copolymers. *Macromolecules* 2009, 42, 5629-5635; (vii) He, J.; Tremblay, L.; Lacelle, S.; Zhao, Y. Preparation of polymer single chain nanoparticles using intramolecular photodimerization of coumarin. *Soft Matter* 2011, 7, 2380-2386; and (viii) Kaitz, J. A.; Possanza, C. M.; Song, Y.; Diesendruck, C. E.; Spiering, A. J. H.; Meijer, E. W.; Moore, J. S. Depolymerizable, adaptive supramolecular polymer nanoparticles and networks. *Polym Chem-Uk* 2014, 5, 3788-3794; which are all incorporated herein by reference.

The methods to induce chain collapse in intramolecular cross linked polymers include: irreversible covalent, such as click chemistry, radical coupling, benzocyclobutane dimerization, Bergmann cyclization, Diels/Alder ligation, photochemical dimerization, substitution reactions, aromatic substitutions, amide or ester formation, Michael addition, etc; reversible covalent (dynamic), such as imine bond, disulfide bond, acetal bond, etc; or noncovalent crosslinking such as hydrogen bonding, π-π bond, ionic bond, coordinative bond etc.

In one embodiment, the SCPN of this invention provides improved resistance to mechanical stress in solution.

Properties of the single-chain nanoparticle (SCNP) formed present: resistance to mechanical stress in solution (extended lifetime); a tunable, mechanically driven change in physical parameters such as size, intrinsic viscosity and solubility (useful in the development of viscosity modifiers and mechanoresponsive materials); and higher rate of reformation of mechanochemically broken covalent bonds, due to increased effective concentration (useful in the development of self-healing materials and artificial enzymes).

In one embodiment, SCPNs provides a new approach to developing mechanoresponsive materials where physical, chemical and optical properties are modified as a function of the mechanical environment.

In one embodiment, the intramolecular crosslinked polymer refers to any intramolecular crosslinked polymer known in the art. In another embodiment, the intramolecular crosslinked polymer is as described in Sudheendran Mavila, Or Eivgi, Inbal Berkovich, and N. Gabriel Lemcoff; "Intramolecular Cross-Linking Methodologies for the Synthesis of Polymer Nanoparticles", *Chemical Reviews*, DOI: 10.1021/acs.chemrev.5b00290 which is incorporated herein by reference.

In another embodiment, the single chain polymer or copolymer comprises polyaminoethyl methacrylate, poly(2-acetoxy)ethyl methacrylate (PAEMA), polystyrene, polyacrylic acid (PAA), polyalanine, polyester, polycarbonate, polyurea, polyurethane, vinyl polymers, polyalkyl, polyalkyl acrylate, polybutadiene, polyamide, PEG, polypropylene glycol, polyacrylamide, polyacrylonitrile (PAN), poly(2-cinnamoylethyl methacrylate) (PCMA), polyalkyl methacrylates, polyisobutene, polyisoprene, polychloroprene, polystyrene-coisoprene, polymethyl methacrylate (PMMA), polylauryl methacrylate, polystearyl methacrylate (PSMA), Poly(vinyl chloride) (PVC), polyethylene, polypropylene, polytetrafluoroethylene (PTFE), polyvinyl cyclohexane, Poly(vinyl acetate) (PVA), polyisocyanatoethyl methacrylate (ICEMA), monosaccharide, disaccharide, or any combination thereof. In another embodiment, any of the monomers of the above polymers can be combined to form a copolymer. In another embodiment, the single chain polymer of the invention is poly(methyl methacrylate-co-(2-acetoxy)ethyl methacrylate) (PMMA-co-PAEMA). In another embodiment, the single chain polymer of the invention is poly(stearyl methacrylate-co-(2-acetoxy)ethyl methacrylate) (PSMA-co-PAEMA).

In one embodiment, the term "polymer" of the "intramolecular crosslinked polymer" of this invention refers also to a co-polymer.

In one embodiment intramolecular crosslinked polymer comprises a single chain polymer or copolymer and a cross-linker, wherein the cross linker links between two different monomers of said single chain polymer. In another embodiment, the cross linker is a monomeric unit and/or any covalent or supramolecular chemical bond linking between two different monomers in the linear chain. In another embodiment, a supramolecular chemical bond includes hydrogen bond, π-π interaction, ionic interaction or hydrophobic interaction. In another embodiment, a co-monomer from the above listed polymers is used as a cross linker.

A "monomeric" unit is defined in this invention as any chemical group with functional groups that is linked between two different monomers of the polymer or copolymer, by covalent bond or a supramolecular bond. Non limiting examples of a monomeric unit is trimethylolpropane triacrylate (TMT), alkanes, dialkylhalides, dialkylamines, dialkylthiols, dialkylhydroxide, dialkylcarbonyl,

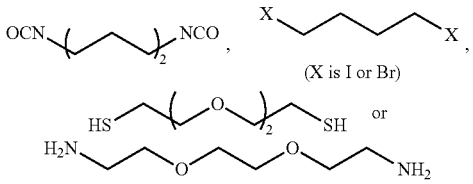

Methods of Preparation

In one embodiment, a method for the preparation of intramolecular crosslinked polymers of the invention is provided. In another embodiment, the method comprises:

a) preparation of the linear chain polymer precursor; and b) crosslinking the linear chain polymer precursor.

In another embodiment, the intramolecular crosslinked polymer is prepared in one step.

In another embodiment, the intramolecular crosslinked polymer is added to the lubricant, so the concentration of the intramolecular crosslinked polymer in the lubricant composition is between 0.001 wt % and 30 wt %.

In one embodiment, the linear chain polymer precursor, used in the method for the preparation of intramolecular crosslinked polymer, comprising a polymerization of monomers. In another embodiment, polymerization methods used in the invention are selected from emulsion polymerization, solution polymerization, suspension polymerization, precipitation polymerization, step growth polymerization, condensation polymerization, chain growth polymerization, addition polymerization, free radical polymerization, cationic polymerization, anionic polymerization, living polymerization, living anionic polymerization, living cationic polymerization, living ring-opening metathesis polymerization, living free radical polymerization, photo polymerization, ring opening polymerization, ring-opening metathesis polymerization, reversible-deactivation radical polymerization (RDRP), reversible addition-fragmentation chain-transfer polymerization (RAFT), Single-Electron Transfer Living Radical Polymerization (SET-LRP), atom transfer radical polymerization (ATRP) and nitroxide-mediated polymerization (NMP). In another embodiment, the polymerization method is reversible addition-fragmentation chain-transfer polymerization (RAFT). In another embodiment, the polymerization method is Single-Electron Transfer Living Radical Polymerization (SET-LRP). In another embodiment, the polymerization method is reversible-deactivation radical polymerization (RDRP). In another embodiment, the polymerization method is atom transfer radical polymerization (ATRP). In another embodiment, the polymerization method is nitroxide-mediated polymerization (NMP). In another embodiment, the polymerization method is free radical polymerization. In another embodiment, the polymerization method is photo polymerization.

In another embodiment, the polymerization method is reversible-deactivation radical polymerization (RDRP). In another embodiment, RDRP comprises monomer polymerization. In another embodiment, the monomer polymerization is metal free and does not comprise any metal or metal ion. In another embodiment, the monomer polymerization employs reagents comprising Cu, Ag, Fe, Co, Mo, Ni, Ti, Ru, La, Ce, Pr, Nd, Pm, Sm, Eu, Gd, Tb, Dy, Ho, Er, Tm, Yb and Lu metals, metal ions thereof or any combination thereof. In another embodiment, the reagents comprise Cu. In another embodiment, the Cu is a Cu(0), Cu(I) or Cu(II) species. In another embodiment, the reagents comprise Fe. In another embodiment, the reagents comprise Co. In another embodiment, the reagents comprise Mo. In another embodiment, the reagents comprise Ni. In another embodiment, the reagents comprise Ti. In another embodiment, the reagents comprise Ru. In another embodiment, the metal or metal ion species is an organometallic complex. In another embodiment, the reagents further comprise ligands. In another embodiment, ligands comprise multidentate ligands. In another embodiment, non limiting examples of ligands include tris[2(dimethylamino)methyl]amine ($Me_6$TREN), tris(2-pyridylmethyl)amine (TPMA) and N,N,N',N",N"-pentamethyldiethylenetriamine (PMDETA). In another embodiment, the reagents further comprise initiators, photoinitiators or any combination thereof. In another embodiment, initiators comprise azo compounds, organic and inorganic peroxides, allyl halides, alpha halo esters, alpha halo nitriles and alpha halo aralkyls. In another embodiment, non limiting examples of initiators include Azobisisobutyronitrile. 2,2'-Azobis(2-methylpropionamidine) dihydrochloride, 1,1'-Azobis(cyclohexanecarbonitrile, 4,4'-Azobis(4-cyanovaleric acid), ditertbutylperoxide, peroxodisulfate, ethyl α-bromophenylacetate (EBPA), methyl 2-bromopropionate (MBrP), 2-bromopropanitrile, ethyl 2-bromoisobutyrate, ethyl 2-bromopropionate, methyl 2-bromopropionate and 1-phenyl ethylbromide. In another embodiment, photoinitiators comprise methylene blue, eosin Y, 10-methyl phenothiazine, phenothiazine, 10-phenyl phenothiazine methyl thioglycolate, acridinium based salts, perylene, fluorescein, silicon, nanometer scale silicon, titania and nanoscale titania.

In another embodiment, the polymerization method is atom transfer radical polymerization (ATRP). In another embodiment, ATRP comprises monomer polymerization. In another embodiment, the monomer polymerization is metal free and does not comprise any metal or metal ion. In another embodiment, the monomer polymerization employs reagents comprising Cu, Ag, Fe, Co, Mo, Ni, Ti, Ru, La, Ce, Pr, Nd, Pm, Sm, Eu, Gd, Tb, Dy, Ho, Er, Tm, Yb and Lu metals, metal ions thereof or any combination thereof. In another embodiment, the reagents comprise Cu. In another embodiment, the Cu is a Cu(0), Cu(I) or Cu(II) species. In another embodiment, the reagents comprise Fe. In another embodiment, the reagents comprise Co. In another embodiment, the reagents comprise Mo. In another embodiment, the reagents comprise Ni. In another embodiment, the reagents comprise Ti. In another embodiment, the reagents comprise Ru. In another embodiment, the metal or metal ion species is an organometallic complex. In another embodiment, the reagents further comprise ligands. In another embodiment, ligands comprise multidentate ligands. In another embodiment, non limiting examples of ligands include tris[2-(dimethylamino)methyl]amine ($Me_6$TREN), tris(2-pyridylmethyl)amine (TPMA) and N,N,N',N",N"-pentamethyldiethylenetriamine (PMDETA). In another embodiment, the reagents further comprise initiators, photoinitiators or any combination thereof. In another embodiment, initiators comprise azo compounds, allyl halides, alpha halo esters, alpha halo nitriles and alpha halo aralkyls. In another embodiment, non limiting examples of initiators include Azobisisobutyronitrile, 2,2'-Azobis(2-methylpropionamidine) dihydrochloride, 1,1'-Azobis(cyclohexanecarbonitrile, 4,4'-Azobis(4-cyanovaleric acid), ditertbutylperoxide, peroxodisulfate, ethyl α-bromophenylacetate (EBPA), methyl 2-bromopropionate (MBrP) 2-bromopropanitrile, ethyl 2-bromoisobutyrate, ethyl 2-bromopropionate, methyl 2-bromopropionate and 1-phenyl ethylbromide. In another embodiment, photoinitiators comprise methylene blue, eosin Y, 10-methyl phenothiazine, phenothiazine, 10-phenyl phenothiazine methyl thioglycolate, acridinium based salts, perylene, fluorescein, silicon, nanometer scale silicon, titania and nanoscale titania.

In another embodiment, the polymerization method is Single-Electron Transfer Living Radical Polymerization (SET-LRP). In another embodiment, SET-LRP comprises monomer polymerization. In another embodiment, the monomer polymerization is metal free and does not comprise any metal or metal ion. In another embodiment, the monomer polymerization employs reagents comprising Cu, Ag, Fe, Co, Mo, Ni, Ti, Ru, La, Ce, Pr, Nd, Pm, Sm, Eu, Gd, Tb, Dy, Ho, Er, Tm, Yb and Lu metals, metal ions thereof or any combination thereof. In another embodiment, the reagents comprise Cu. In another embodiment, the Cu is a Cu(0), Cu(I) or Cu(II) species. In another embodiment, the reagents comprise Fe. In another embodiment, the reagents comprise Co. In another embodiment, the reagents comprise Mo. In another embodiment, the reagents comprise Ni. In another embodiment, the reagents comprise Ti. In another embodiment, the reagents comprise Ru. In another embodiment, the metal or metal ion species is an organometallic complex. In another embodiment, the reagents further comprise ligands. In another embodiment, ligands comprise multidentate ligands. In another embodiment, non limiting examples of ligands include tris[2-(dimethylamino)methyl]amine ($Me_6$TREN), tris(2-pyridylmethyl)amine (TPMA) and N,N,N',N",N"-pentamethyldiethylenetriamine (PMDETA). In another embodiment, the reagents further comprise initiators, photoinitiators or any combination thereof. In another embodiment, initiators comprise azo compounds, allyl halides, alpha halo esters, alpha halo nitriles and alpha halo aralkyls. In another embodiment, non limiting examples of initiators include Azobisisobutyronitrile, 2,2'-Azobis(2-methylpropionamidine) dihydrochloride, 1,1'-Azobis(cyclohexanecarbonitrile, 4,4'-Azobis(4-cyanovaleric acid), ditertbutylperoxide, peroxodisulfate, ethyl α-bromophenylacetate (EBPA), methyl 2-bromopropionate (MBrP) 2-bromopropanitrile, ethyl 2-bromoisobutyrate, ethyl 2-bromopropionate, methyl 2-bromopropionate and 1-phenyl ethylbromide. In another embodiment, photoinitiators comprise methylene blue, eosin Y, 10-methyl phenothiazine, phenothiazine, 10-phenyl phenothiazine methyl thioglycolate, acridinium based salts, perylene, fluorescein, silicon, nanometer scale silicon, titania and nanoscale titania.

In another embodiment, the polymerization method is reversible addition-fragmentation chain-transfer polymerization (RAFT). In another embodiment, RAFT comprises monomer polymerization. In another embodiment, the monomer polymerization is metal free and does not comprise any metal or metal ion. In another embodiment, the monomer polymerization is photochemical. In another embodiment, the monomer polymerization employs reagents comprising Cu, Ag, Fe, Co, Mo, Ni, Ti, Ru, La, Ce, Pr, Nd, Pm, Sm, Eu, Gd, Tb, Dy, Ho, Er, Tm, Yb and Lu metals, metal ions thereof or any combination thereof. In another embodiment, the reagents comprise Cu. In another embodiment, the Cu is a Cu(0), Cu(I) or Cu(II) species. In another embodiment, the reagents comprise Fe. In another embodiment, the reagents comprise Co. In another embodiment, the reagents comprise Mo. In another embodiment, the reagents comprise Ni. In another embodiment, the reagents comprise Ti. In another embodiment, the reagents comprise Ru. In another embodiment, the metal or metal ion species is an organometallic complex. In another embodiment, the reagents further comprise ligands. In another embodiment, the reagents do not comprise ligands. In another embodiment, ligands comprise multidentate ligands. In another embodiment, non limiting examples of ligands include tris[2-(dimethylamino)methyl]amine ($Me_6$TREN), tris(2-pyridylmethyl)amine (TPMA) and N,N,N',N",N"-pentamethyldiethylenetriamine (PMDETA). In another embodiment, the reagents further comprise initiators, photoinitiators, RAFT agents or any combination thereof. In another embodiment, initiators comprise azo compounds, allyl halides, alpha halo esters, alpha halo nitriles, alpha halo aralkyls and thiocarbonyl derivatives. In another embodiment, non limiting examples of initiators include Azobisisobutyronitrile, 2,2'-Azobis(2-methylpropionamidine) dihydrochloride, 1,1'-Azobis(cyclohexanecarbonitrile, 4,4'-Azobis(4-cyanovaleric acid), ditertbutylperoxide, peroxodisulfate, ethyl α-bromophenylacetate (EBPA), methyl 2-bromopropionate (MBrP) 2-bromopropanitrile, ethyl 2-bromoisobutyrate, ethyl 2-bromopropionate, methyl 2-bromopropionate and 1-phenyl ethylbromide. In another embodiment, photoinitiators comprise methylene blue, eosin Y, 10-methyl phenothiazine, phenothiazine, 10-phenyl phenothiazine methyl thioglycolate, acridinium based salts, perylene, fluorescein, silicon, nanometer scale silicon, titania and nanoscale titania. In another embodiment, RAFT agents are used in a photochemical reaction. In another embodiment, RAFT agents are used in a thermal reaction. In another embodiment, RAFT agents have a general structure of R—S—C(═S)—Z, wherein R is a free radical leaving group (that must be able to reinitiate polymerization); the C═S is a reactive double bond; Z group controls C═S bond reactivity; and the C—S bond between the R and adjacent S is a weak bond. In another embodiment, RAFT agents comprise dithioesters, thionoesters, trithiocarbonates, dithiocarbamates, xanthates and thiocarbonylthio compounds. In another embodiment, non limiting examples of RAFT agents are selected from 2-Cyano-2-propyl benzodithioate, Cyanomethyl methyl(phenyl)carbamodithioate, Cyanomethyl dodecyl trithiocarbonate, 4-Cyano-4-(phenylcarbonothioylthio)pentanoic acid and 2-(Dodecylthiocarbonothioylthio)-2-methylpropionic acid.

In one embodiment, the monomers used for the polymers or co-polymers comprise aminoethyl methacrylate, (2-acetoxy)ethyl methacrylate, styrene, acrylic acid, alanine, ester, carbonate ester, urea, urethane, ethylenes, alkyls, alkyl acrylate, butadiene, amide, ethylene glycol, propylene glycol, acrylamide, acrylonitrile, 2-cinnamoylethyl methacrylate, alkyl methacrylates, isobutene, isoprene, chloroprene, styrene, isoprene, methyl methacrylate, lauryl methacrylate, stearyl methacrylate, vinyl chloride, ethylene, propylene, tetrafluoroethylene, vinyl cyclohexane, vinyl acetate, isocyanatoethyl methacrylate, monosaccharide, disaccharide, or any combination thereof. In another embodiment, any of the monomers of the above can be combined and polymerized to form a copolymer to be used as linear chain (co) polymer precursor. In another embodiment, the monomer of the invention is a mixture of methyl methacrylate and (2-acetoxy)ethyl methacrylate. In another embodiment, the monomer of the invention is a mixture of stearyl methacrylate (2-acetoxy)ethyl methacrylate).

In another embodiment, the step of crosslinking the linear chain polymer precursor comprises a crosslinking reaction of cross linker with the linear chain polymer precursor. In another embodiment, the cross linker used in the crosslinking reaction links between two different monomers of said single chain polymer. In another embodiment, the cross linker used in the crosslinking reaction is a monomeric unit and/or any covalent or supramolecular chemical bond linking between two different monomers in the linear chain. In another embodiment, a supramolecular chemical bond includes hydrogen bond, π-π interaction, ionic interaction or hydrophobic interaction. In another embodiment, a monomer from the above listed monomers is used as a cross linker.

In another embodiment, a "monomeric" unit which acts as the cross linker in the crosslinking reaction is defined in this invention as any chemical group with functional groups that is linked between two different monomers of the polymer or copolymer, by covalent bond or a supramolecular bond. Non limiting examples of a monomeric unit is trimethylolpropane triacrylate (TMT), alkanes, dialkylhalides, dialkylamines, dialkylthiols, dialkylhydroxide, dialkylcarbonyl,

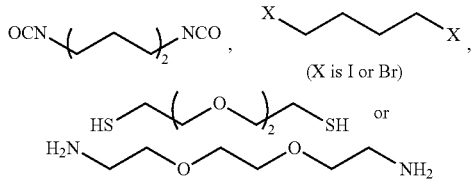

Uses

Lubricating oils are an important part of everyday life. Their use varies considerably: motors in cars, heavy machinery in industry, turbines in power plants etc. There are over 10 thousand different oil formulations to satisfy all the different lubricating applications.

The technology involving lubricating oils is pronounced, and is mostly restricted to industrial research, developing new, specialized oils to specific applications. While the main component of the lubricant is restricted to a number of possibilities, the additives which improve their properties are massive and varied. Lubricating oils contain detergents, dispersants, oxidation and corrosion inhibitors, antiwear additives, viscosity modifiers, pour point depressants, to cite a few. Interestingly, many of these additives are polymeric materials. These are dissolved in the oil and undergo the extreme conditions that the lubricants go through including high temperatures, shear etc. Because of that, some of the additives are there to stabilize other additives.

From all the important roles polymers take in improving lubricants, the most central are viscosity modifiers, which maintains the required oil viscosity at high temperatures (which are typically created due to friction). In most lubricants the base oil accounts for 95% of the formulation composition, but the variance is large. Chemical additives can be only 1% of the lubricant, in the case of some hydraulic oils, and up to 30% in gear lubricants. Viscosity modifiers occupy between 0.5 and 25% of the formulation, being the most significant additive in quantity.

The oil viscosity is reduced at higher temperatures, but due to increased polymer solubility, the viscosity is increased as a consequence of the polymer-oil interaction.

Intrinsic viscosity of a polymer increases with its molecular weight, and therefore, polymers with higher molecular should make better viscosity modifiers. Since the polymer solubility may be low in the oil medium, one would prefer to use a lower quantity of a higher molecular weight (i.e. higher intrinsic viscosity) polymer.

However, higher molecular weight polymers undergo mechanochemical bond scission faster. Mechanochemical bond ruptures are most common close to polymer center, causing a significant molecular weight decrease and as a consequence, reducing the additive efficiency, rendering the oil ineffective. For that reason, lubricant industry compromises between two opposing effects in order to choose the molecular weight of the additives for the oil, better viscosity properties on one side, lower mechanical resistance on the other.

Accordingly, this invention is directed to intramolecular cross linked polymers which at high molecular weights have architectures that make it more resistant to bond ruptures, or, alternatively, does not influence intrinsic viscosity of the resulting polymer which can be used as viscosity modifier in a lubricant composition, resulting in more efficient and durable lubricants.

In one embodiment, this invention is directed to a lubricating composition comprising at least one intramolecular crosslinked polymer. In another embodiment, the lubricating composition includes one, two or three different intramolecular crosslinked polymers.

In one embodiment, this invention provides a method of stabilizing a lubricant composition, wherein said method comprises adding a viscosity modifier comprising an intramolecular crosslinked polymer.

In another embodiment, the intramolecular crosslinked polymer is an additive in a lubricating composition. In another embodiment, the intramolecular crosslinked polymer is a viscosity modifier, in a lubricating composition. In another embodiment, the intramolecular crosslinked polymer is pour point depressant in a lubricating composition.

In another embodiment, the polymer or copolymer has MW of between 30 kg/mol and 15000 kg/mol. In another embodiment, the polymer or copolymer has MW of between 30 kg/mol and 500 kg/mol. In another embodiment, the polymer or copolymer has MW of between 50 kg/mol and 300 kg/mol. In another embodiment, the polymer or copolymer has MW of between 30 kg/mol and 1000 kg/mol. In another embodiment, the polymer or copolymer has MW of between 100 kg/mol and 500 kg/mol. In another embodiment, the polymer or copolymer has MW of between 1000 kg/mol and 3,000 kg/mol. In another embodiment, the polymer or copolymer has MW of between 3000 kg/mol and 5,000 kg/mol. In another embodiment, the polymer or copolymer has MW of between 5000 kg/mol and 15,000 kg/mol. In another embodiment, the intramolecular crosslinked polymer includes between 0.1 mol % and 30 mol % of said cross linker. In another embodiment, the intramolecular crosslinked polymer includes between 0.1 mol % and 1 mol %. In another embodiment, the intramolecular crosslinked polymer includes between 0.5 mol % and 15 mol %. In another embodiment, the intramolecular crosslinked polymer includes between 0.3 mol % and 5 mol %. In another embodiment, the intramolecular crosslinked polymer includes between 1 mol % and 15 mol %. In another embodiment, the intramolecular crosslinked polymer includes between 1 mol % and 10 mol %. In another embodiment, the intramolecular crosslinked polymer includes between 1 mol % and 5 mol %.

In one embodiment, the concentration of the intramolecular crosslinked polymer in the lubricant composition is between 0.001 wt % and 30 wt %. In another embodiment, the concentration of the intramolecular crosslinked polymer in the lubricant composition is between 0.001 wt % and 0.05 wt %. In another embodiment, the concentration of the intramolecular crosslinked polymer in the lubricant composition is between 0.001 wt % and 0.01 wt %. In another embodiment, the concentration of the intramolecular crosslinked polymer in the lubricant composition is between 0.001 wt % and 0.1 wt %. In another embodiment, the concentration of the intramolecular crosslinked polymer in the lubricant composition is between 0.05 wt % and 1 wt %. In another embodiment, the concentration of the intramolecular crosslinked polymer in the lubricant composition is between 0.001 wt % and 1 wt %. In another embodiment, the concentration of the intramolecular crosslinked polymer in the lubricant composition is between 0.1 wt % and 10 wt %. In another embodiment, the concentration of the intramolecular crosslinked polymer in the lubricant composition is between 1 wt % and 30 wt %. In another embodiment, the concentration of the intramolecular crosslinked polymer in the lubricant composition is between 3 wt % and 25 wt %. In another embodiment, the concentration of the intramolecular crosslinked polymer in the lubricant composition is between 5 wt % and 30 wt %.

In one embodiment, this invention is directed to a lubricating composition comprising an intramolecular crosslinked polymer. In another embodiment, the intramolecular crosslinked polymer is more resistant to mechanochemical scission compared to linear polymer with the same MW range in solution.

In one embodiment, the intramolecular crosslinked polymers having resistance to mechanical stress in a liquid is used as a drag reducing agent, reducing turbulence in flow of a liquid. In another embodiment, the intramolecular crosslinked polymers having resistance to mechanical stress is used for reducing turbulence in flow of water. In another embodiment, the intramolecular crosslinked polymers having resistance to mechanical stress is used for reducing turbulence in flow of oil. In another embodiment, the intramolecular crosslinked polymers having resistance to mechanical stress is used for reducing turbulence in flow of petroleum.

In one embodiment, this invention provides a lubricating composition with shear stability index values of between −10 and 15. In another embodiment, the shear stability index values are between −8 and 13. In another embodiment, the shear stability index values are between −6 and 10. In another embodiment, the shear stability index values are between −−4 and 9. In another embodiment, the shear stability index values are between −3 and 8. In another embodiment, the shear stability index values are between −2.5 and 7.7.

In one embodiment, this invention provides a lubricating composition with viscosity index values of between 70 and 300. In another embodiment, the viscosity index values are between 75 and 280. In another embodiment, the viscosity index values are between 80 and 240. In another embodiment, the viscosity index values are between 83 and 200. In another embodiment, the viscosity index values are between 85 and 180. In another embodiment, the viscosity index values are between 88 and 160. In another embodiment, the viscosity index values are between 90 and 140. In another embodiment, the viscosity index values are between 95 and 135. In another embodiment, the viscosity index values are between 100 and 130. In another embodiment, the viscosity index values are between 103 and 128.

In one embodiment, this invention provides a method of reducing turbulence in flow of a liquid comprising adding to said liquid an intramolecular crosslinked polymer.

In one embodiment, the concentration of the intramolecular crosslinked polymer in the liquid is between 0.00001 wt % (0.1 ppm) and 1 wt %. In another embodiment, the concentration of the intramolecular crosslinked polymer in the liquid is between 0.0001 wt % (1 ppm) and 0.01 wt % (100 ppm). In another embodiment, the concentration of the intramolecular crosslinked polymer in the liquid is between 0.001 wt % (10 ppm) and 0.1 wt %. In another embodiment, the concentration of the intramolecular crosslinked polymer in the liquid is between 0.001 wt % (10 ppm) and 1 wt %. In one embodiment, the concentration of the intramolecular crosslinked polymer in the liquid is between 0.01 wt % and 1 wt %. In one embodiment, the intramolecular crosslinked polymers having resistance to mechanical stress is used in paint to increase its toughness or hardness.

In another embodiment, the intramolecular crosslinked polymer is added to the lubricant, so the concentration of the intramolecular crosslinked polymer in the lubricant composition is between 0.001 wt % and 30 wt %.

In one embodiment, the invention provides a method of preparing a lubricant composition, comprising the steps of: synthesis of intramolecular crosslinked polymer and adding said intramolecular crosslinked polymer to a lubricant.

In another embodiment, the intramolecular crosslinked polymer is prepared by (i) synthesis of linear chain polymer precursor from monomers; and (ii) crosslinking the linear chain polymer precursor to afford an intramolecular cross-linked polymer. In another embodiment, the intramolecular crosslinked polymer is prepared in one step.

The following examples are presented in order to more fully illustrate the preferred embodiments of the invention. They should in no way be construed, however, as limiting the broad scope of the invention.

EXAMPLES

Example 1

Figure 3:
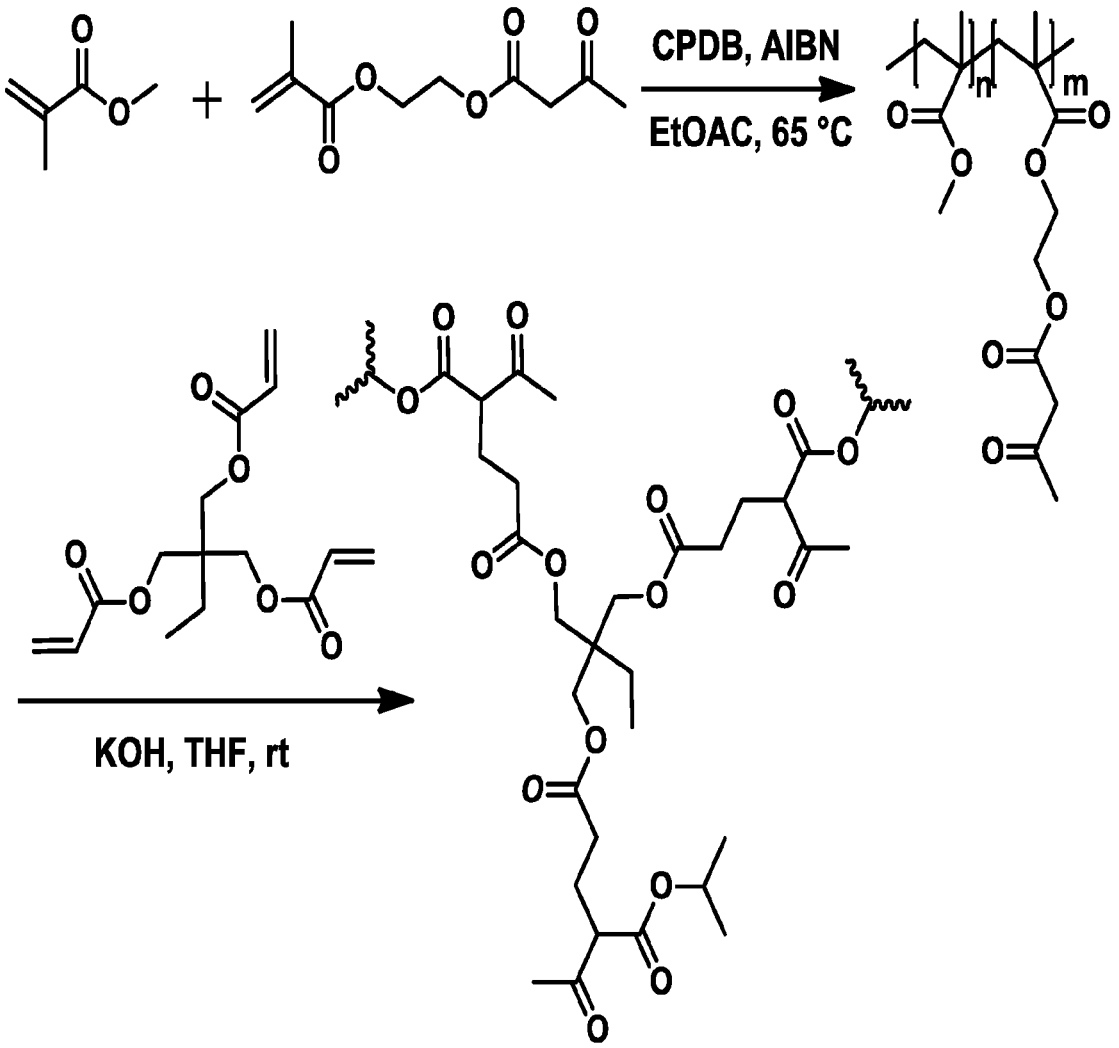
FIG. 3 depicts a synthetic scheme of intramolecular cross-linked copolymer of PMMA (Poly(methyl methacrylate) and PAEMA poly(2-acetoxyethyl methacrylate) cross linked with TMT (trimethylolpropane triacrylate).
Figure 4:
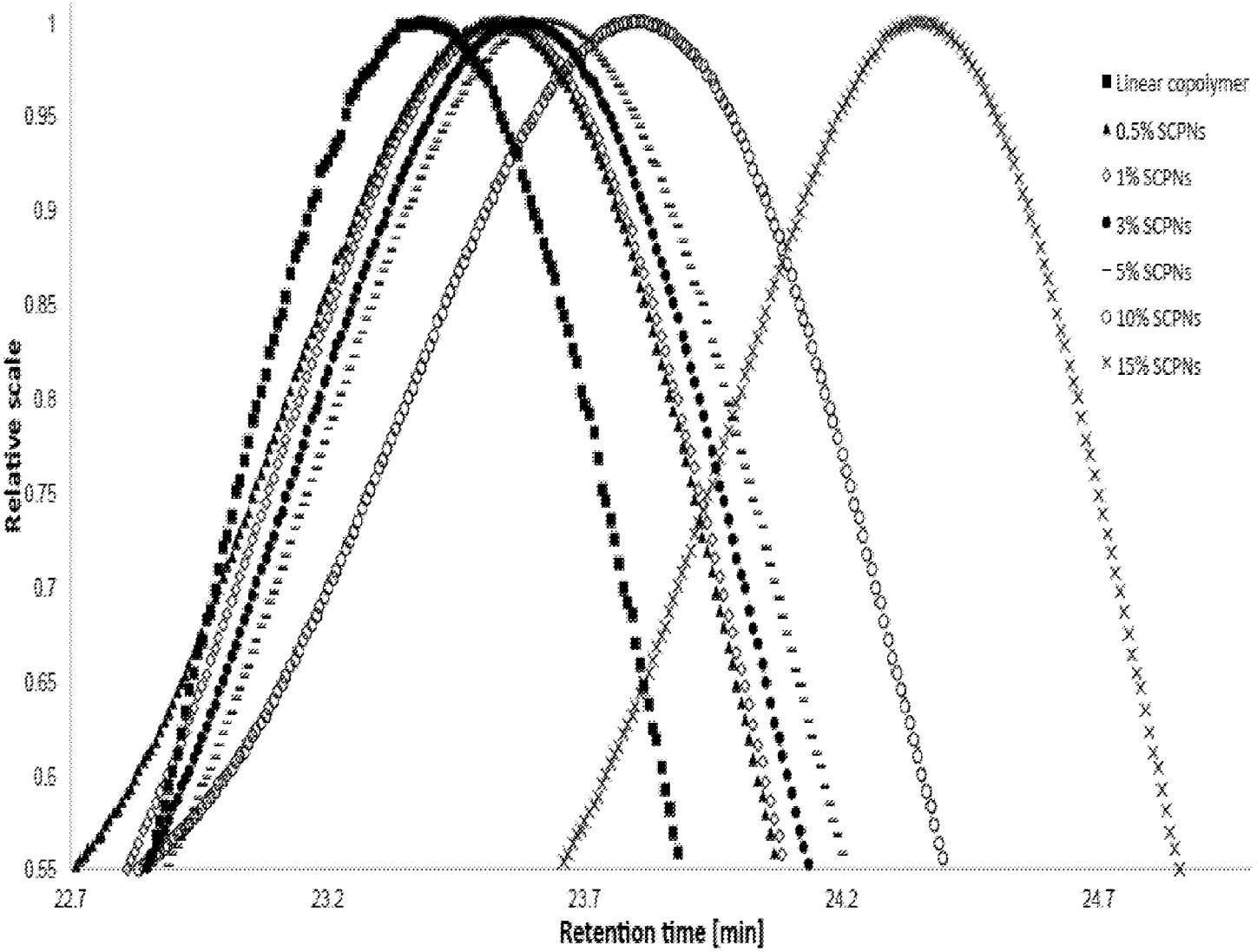
FIG. 4 depicts chromatograms of prepared linear polymer of copolymer of PMMA-PAEMA and intramolecular cross-linked polymer of FIG. 3 with same degree of polymerization and cross-linking density of 0.5 mol %, 1 mol %, 3 mol %, 5 mol %, 10 mol % and 15 mol %.

Preparation and Characterization of PMMA-AEMA Intramolecular Cross-Linked Polymer Intramolecular cross linked PMMA was prepared according to the synthesis of Pomposo et. al [Ana Sanchez-Sanchez, Somayeh Akbari, Agustfn Etxeberria, Arantxa Arbe, Urs Gasser, Angel J. Moreno, Juan Colmenero, and Jose A. Pomposo, *ACS Macro Lett.,* 2013, 2, 491-495] and presented in FIG. 3. The linear polymer was prepared using RAFT polymerization with methyl methacrylate (MMA) and 2-(acetoxy)ethyl methacrylate (AEMA) monomers in different ratios, providing polymers with low polydispersities; and Michael addition for cross-linking.

100 kDa PMMA were prepared with 15 mol % of the AEMA, and added 0, 0.5, 1, 3, 5, 10 and 15 mol eq. of the trimethylolpropane triacrylate (TMT) cross-linker, so that different intramolecularly cross-linked polymers were made, all with the same degree of polymerization (length). The intramolecular cross-linking had the expected effect of induced folding in the polymer, caused it to become smaller in size, as presented in Table 1, as well as by the change in the retention time of the GPC.

TABLE 1

Properties of PMMA-AEMA intramolecular cross-linked polymer as a function of cross-link density

| Cross linked density (mol %) | MW (kDa) | Polydispersity (PDI) | Radius Hydrodynamic (Rh, nm) | Intrinsic viscosity (ml/g) | Tg (° C.) |
|---|---|---|---|---|---|
| 0 | 109 | 1.02 | 8.1 | 30.9 | 96 |
| 0.5 | 111 | 1.06 | 7.7 | 26.7 | 105 |
| 1 | 110 | 1.03 | 7.7 | 26.3 | 106 |
| 3 | 109 | 1.02 | 7.6 | 26.1 | 106 |

TABLE 1-continued

Properties of PMMA-AEMA intramolecular cross-linked polymer as a function of cross-link density

| Cross linked density (mol %) | MW (kDa) | Polydispersity (PDI) | Radius Hydrodynamic (Rh, nm) | Intrinsic viscosity (ml/g) | Tg (° C.) |
|---|---|---|---|---|---|
| 5 | 115 | 1.02 | 7.5 | 23.3 | 109 |
| 10 | 124 | 1.02 | 7.3 | 20.3 | 109 |
| 15 | 125 | 1.02 | 6.1 | 11.6 | 113 |

Example 2

Mechanochemical Stability of PMMA-AEMA Intramolecular Cross-Linked Polymer

The mechanochemical stability of the PMMA-AEMA intramolecular cross linked polymer (as described and prepared in Example 1) was determined using ultrasonication. Ultrasonication is one of the ASTM methods used in industry to test the shear stability of polymer-containing oils. Polymer samples were dissolved in THF in a concentration of ca. 1 mg/ml and, under nitrogen and cooled, sonicated (pulsing) at low temperatures. Samples were taken every 15 mins and tested by triple-detector GPC.

Figure 5:
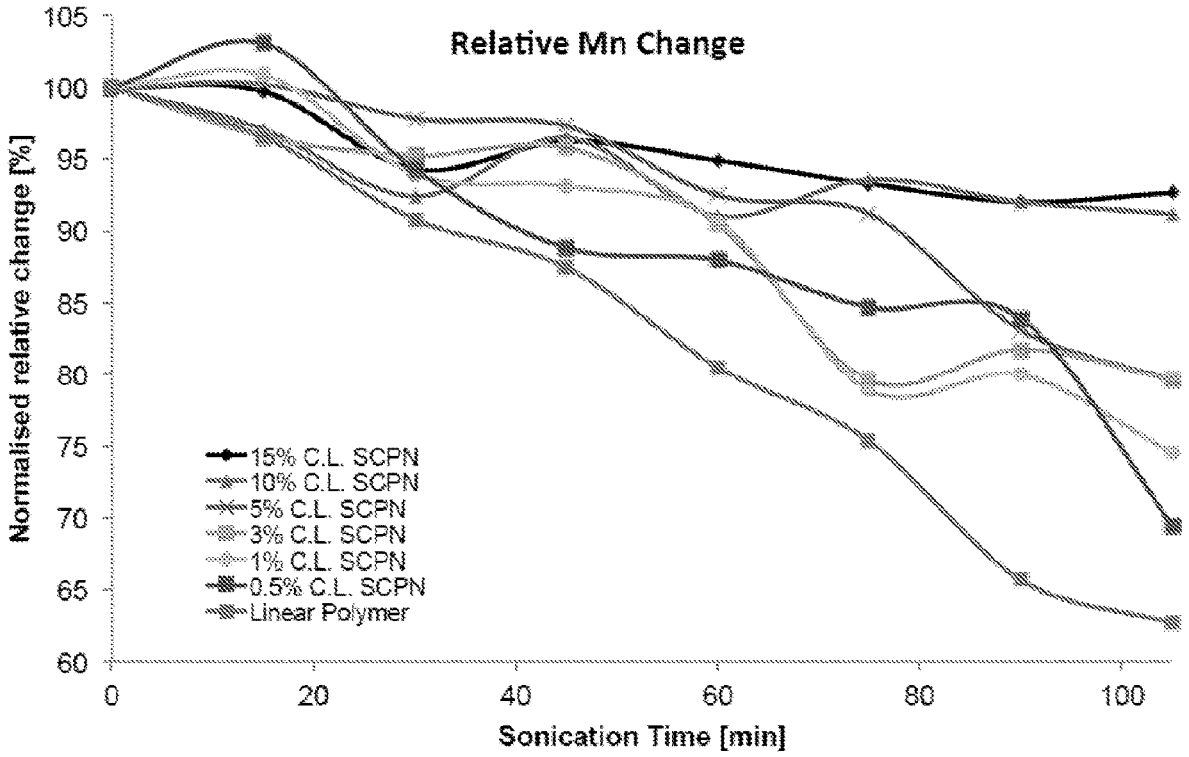
FIG. 5 presents change in average molecular weight (Mn) over sonication time of linear polymer of copolymer of PMMA-PAEMA and intramolecular crosslinked polymer presented in FIG. 3. The number average molecular weight is the statistical average molecular weight of all the polymer chains in the sample is defined as Mn.
Figure 6:
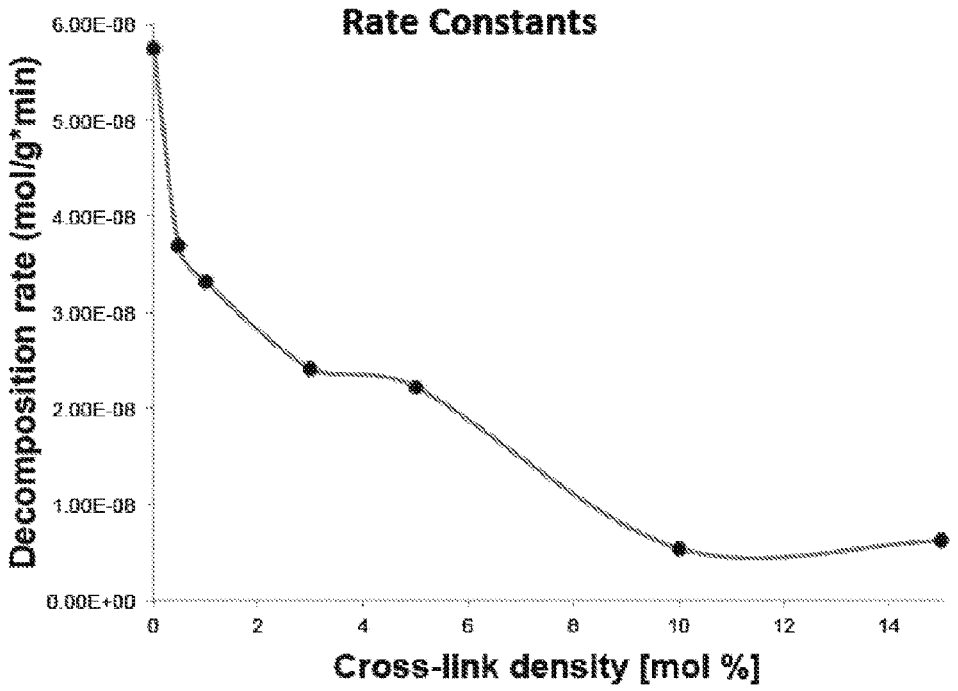
FIG. 6 presents mechanochemical decomposition rate constants as a function of crosslink density of the intramolecular crosslinked polymer presented in FIG. 3.

FIG. 5 demonstrates that the linear polymer (0% cross-link) decreased in molecular weight faster than the polymers having different amounts of cross-linkers. 0.5, 1, and 3 mol %, as well as 10 mol % and 15 mol % were statistically indifferent as groups. The rate constants were calculated from each curve, showing that the decomposition rate is slower for higher cross-link density (FIG. 6). The decomposition rate constant for 0.5 and 1 mol % cross-link was ca. half of the constant of the linear polymer; for 3 and 5 mol % the rate constant was ca. a third of the linear polymer, and for 10 and 15 mol % the degradation rate constant was ca. 10 times smaller compared to the linear polymer Importantly, the 10 and 15 mol % cross-linked polymers showed almost no change in average molecular weight.

Figure 7:
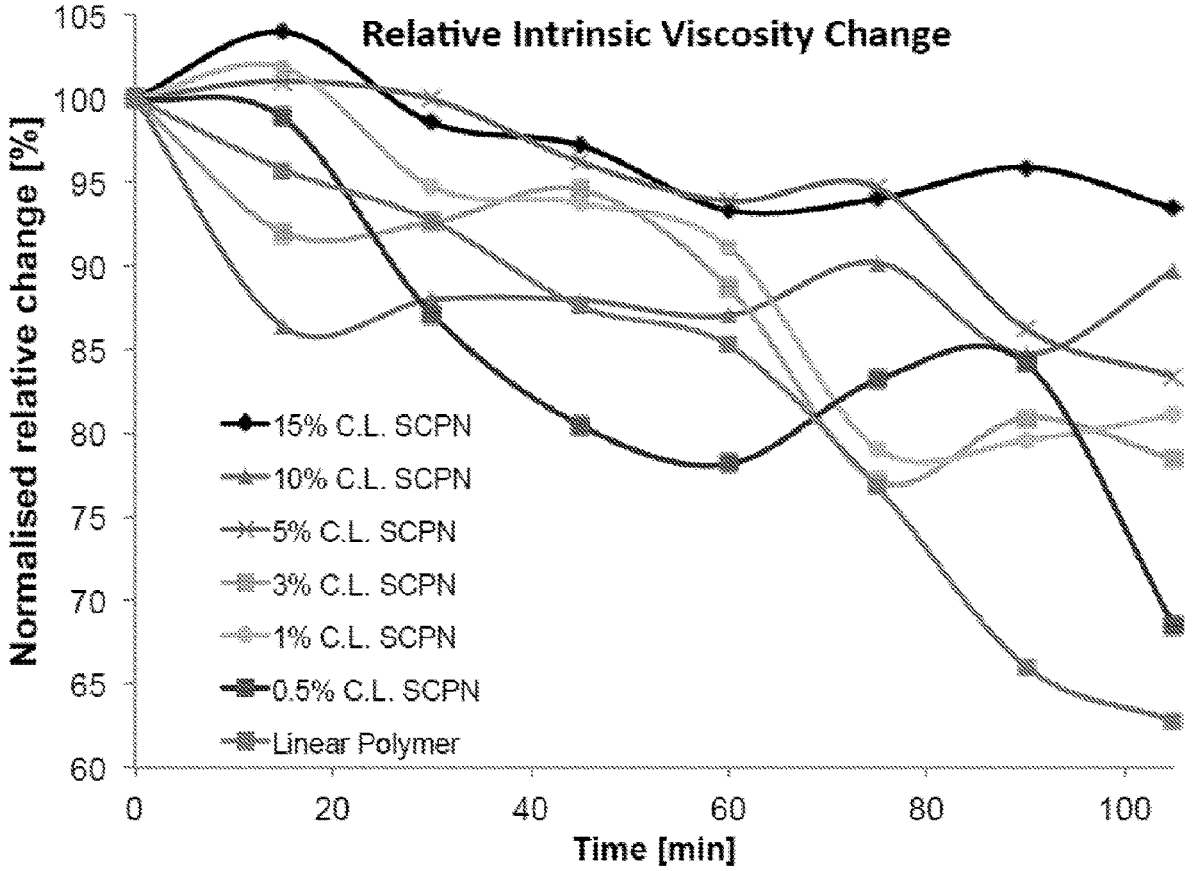
FIG. 7 presents changes in intrinsic viscosity over sonication time of a linear polymer of copolymer of PMMA-PAEMA and intramolecular crosslinked polymer presented in FIG. 3 with of different cross-linking density and the same degree of polymerization.

While the change in molecular weight is an important factor, the most practical implication is the change in intrinsic viscosity. This resistance can also be observed at the intrinsic viscosity measurements by a viscometer using Mark-Howink curves. (FIG. 7)

The changes in the intrinsic viscosity were determined after ca. 2 h sonication. The linear polymer lost 35% of its original intrinsic viscosity, while the 10 and 15% cross-linked polymer lost only ca. 5%.

Example 3

Preparation and Characterization of Linear PSMA-AEMA

Linear polymer PSMA-co-AEMA was prepared according to the following procedure. Melted SMA (32.38 g, 95.6 mmol), AAEMA (4.16 g, 19.4 mmol), and 73 mL of a 1:4 v/v mixture of isopropanol and toluene were added to a 500 mL Schlenk flask. 1 mL toluene solution of tris[2-(dimethylamino)ethyl]amine ($Me_6TREN$) (15 mg, 63.2 μmol) was added, and the solution was deoxygenated by bubbling of argon for 15 minutes, followed by 4 freeze-pump-thaw cycles. Copper strips freshly made from 15 cm of wire were then added, and the mixture was thermostated at 40° C. The reaction was started by addition of 1 mL of deoxygenated toluene solution of Ethylene bis(2-bromoisobutyrate) (23 mg, 63.2 μmol) through a syringe. Reaction progress was followed visually by the increase in viscosity and by $^1$H-NMR and GPC of aliquots. After 31 hours the pale green reaction mixture was diluted with pentane (400 mL) and eluted through a short neutral alumina column to remove inorganic impurities. The mixture was then concentrated to ca. 100 mL and diluted by dichloromethane (100 mL). The polymer was purified by 3 cycles of precipitation from methanol (1 L). The polymer was collected on a fritted Buchner funnel, crushed with a glass rod, dried by air, and by vacuum. The polymer was characterized by $^1$H-NMR and triple-detector GPC.

TABLE 2

Different examples of prepared PSMA-AEMA by method described in example 3 using different quantities of monomers and intitiator.

| Polymer | MW (kDa) | Polydispersity (PDI) | Radius Hydrodynamic (Rh, nm) | Reaction Yield (%) | AEMA inclusion (%) |
|---|---|---|---|---|---|
| 1 | 441 | 1.27 | 15.9 | 84 | 23.9 |
| 2 | 203 | 1.199 | 10.4 | 82 | 15 |
| 3 | 138 | 1.068 | 8.5 | 66 | 27.2 |
| 4 | 205 | 1.294 | 10.3 | 65 | 21.5 |
| 5 | 666 | 1.361 | 19.9 | 81 | 18.7 |

Example 4

Preparation and Characterization of Intramolecular Cross-Linked PSMA-AEMA

In an Erlenmeyer flask thermostated to RT, linear PSMA-AEMA (0.75 g) was dissolved in THF (250 mL) for 15 min with argon bubbling. A MeOH solution of KOH (18 mg, 0.32 mmol, 1 mL) was added, and the mixture was stirred for additional 10 min under Ar, after which a MeOH solution of TMT (43 mg, 0.146 mmol, 0.5 mL) was added, after which the flask was sealed. After 24 hours, 0.5M $H_2SO_4$ (0.35 mL) was added to neutralize the reaction. The reaction mixture was concentrated under reduced pressure to ca. 30 mL, and the polymer was purified by precipitation from methanol (300 mL). The polymer was collected on a fritted Buchner funnel, crushed with a glass rod, dried by air, and by vacuum.

TABLE 3

Different examples of prepared cross-linked PSMA-AEMA by method described in example 4.

| Polymer | MW (kDa) | Polydispersity (PDI) | Radius Hydrodynamic (Rh, nm) | Reaction Yield (%) | Cross-link density (%) |
|---|---|---|---|---|---|
| 1c | 434 | 1.691 | 14.5 | 94 | 22.4 |
| 2c | 233 | 1.273 | 10 | 91 | 12 |
| 3c | 145 | 1.094 | 7.9 | 90 | 12.3 |
| 4c | 264 | 1.306 | 11.1 | 91 | 18.5 |

Example 5

Dissolution of PSMA-AEMA in Oils

In a 50 mL beaker, polymer (243 mg) is stirred with oil (110 cp at room temperature, VI 59, 24.05 g) at 90° C. during 1 hour to make a 1% solution. The resulted clear solution is left unstirred for additional 15 minutes at the same temperature for removal of residual air bubbles. Characterization is done by at least 4 viscosity measurement at 40° C. and 100° C. for the calculation of viscosity index (VI) according to ASTM D2270.

Example 6

Mechanochemical Stability of Oil Containing PSMA-AEMA Intramolecular Cross-Linked Polymer The mechanochemical stability of the polymers is tested in accordance to the procedure described in ASTM D2603. Shear stability index (SSI) is calculated at 40° C. from the equation: SSI (%)=100*($V_i$−$V_s$)/$V_i$, in which $V_i$ and $V_s$ are the viscosities of the initial or sheared polymer solutions, respectively.

TABLE 4

SSIs obtained for polymers in table 3.

| Polymer | MW (kDa) | VI (viscosity index) | SSI |
|---|---|---|---|
| 2c | 233 | 126 | −2.3 |
| 3c | 145 | 132 | −0.5 |
| 4c | 264 | 105 | 7.5 |

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A lubricating composition comprising a base oil and an intramolecular crosslinked polymer, wherein said intramolecular crosslinked polymer comprises between 0.1 mol % and 30 mol % of crosslinkers, said crosslinker links between two different monomers of the same chain of said intramolecular crosslinked polymer.

2. The lubricating composition of claim 1, wherein said intramolecular crosslinked polymer is a viscosity modifier or a pour point depressant.

3. The lubricating composition of claim 1, wherein the concentration of said intramolecular cross linked polymer in said lubricating composition is between 0.001 wt % and 30 wt %.

4. The lubricating composition of claim 1, wherein said intramolecular crosslinked polymer comprises a single chain of a polymer or copolymer and said cross-linker, wherein the cross linker links between two different monomers of said single chain polymer or copolymer.

5. The lubricating composition of claim 4, wherein said single chain polymer or copolymer comprises poly(aminoethyl methacrylate), poly(2-acetoxy)ethyl methacrylate (PAEMA), polystyrene, polyacrylic acid (PAA), polyalanine, polyester, polycarbonate, polyurea, polyurethane, vinyl polymers, polyalkyl, polyalkyl acrylate, polybutadiene, polyamide, PEG, polypropylene glycol, polyacrylamide, polyacrylonitrile (PAN), poly(2-cinnamoylethyl methacrylate) (PCMA), polyalkyl methacrylates, polyisobutene, polyisoprene, polychloroprene, poly(styrene-co-isoprene), polymethyl methacrylate (PMMA), polylauryl methacrylate, polystearyl methacrylate (PSMA), poly(vinyl chloride) (PVC), polypropylene, polytetrafluoroethylene (PTFE), polyvinyl cyclohexane, poly(vinyl acetate) (PVA), polyisocyanatoethyl methacrylate (ICEMA), monosaccharide, disaccharide, or any combination thereof.

6. The lubricating composition of claim 5, wherein said single chain polymer or copolymer is PMMA, PSMA, isoprene copolymer, PSMA-PAEMA or PMMA-PAEMA copolymer.

7. The lubricating composition of claim 4, wherein said intramolecular crosslinked polymer is PMMA-PAEMA cross linked by trimethylolpropane triacrylate (TMT).

8. The lubricating composition of claim 1, wherein the single chain polymer or copolymer has MW of between 30 kg/mol and 15000 kg/mol.

9. The lubricating composition of claim 4, wherein said intramolecular crosslinked polymer is PSMA-PAEMA cross linked by trimethylolpropane triacrylate (TMT).

10. The lubricating composition of claim 1, wherein said lubricating composition has shear stability index values of between −10 and 15.

11. The lubricating composition of claim 1, wherein said lubricating composition has viscosity index values of between 70 and 300.

12. The lubricating composition of claim 1, wherein said intramolecular crosslinked polymer is more resistant to mechanochemical scission compared to linear polymer with the same MW range in solution.

13. A method of stabilizing a lubricant composition comprising a base oil, the method comprising adding to said base oil an intramolecular crosslinked polymer as an additive wherein said intramolecular crosslinked polymer comprises between 0.1 mol % and 30 mol % of crosslinkers, wherein said crosslinker links between two different monomers of the same chain of said intramolecular crosslinked polymer.

14. The method of claim 13, wherein said intramolecular crosslinked polymer is a viscosity modifier or a pour point depressant.

15. The method of claim 13, wherein said intramolecular crosslinked polymer comprises a single chain polymer or copolymer and a cross-linker.

16. The method of claim 13, wherein the single chain polymer or copolymer has MW of between 30 kg/mol and 15000 kg/mol.

17. The method of claim 13, wherein the concentration of said intramolecular cross linked polymer in said lubricant is between 0.001 wt % and 30 wt %.

18. The method of claim 15, wherein said single chain polymer or copolymer comprises poly(aminoethyl methacrylate), poly(2-acetoxy)ethyl methacrylate (PAEMA), polystyrene, polyacrylic acid (PAA), polyalanine, polyester, polycarbonate, polyurea, polyurethane, vinyl polymers, polyalkyl, polyalkyl acrylate, polybutadiene, polyamide, PEG, polypropylene glycol, polyacrylamide, polyacrylonitrile (PAN), poly(2-cinnamoylethyl methacrylate) (PCMA), polyalkyl methacrylates, polyisobutene, polyisoprene, polychloroprene, poly(styrene-co-isoprene), polymethyl methacrylate (PMMA), polylauryl methacrylate, polystearyl methacrylate (PSMA), poly(vinyl chloride) (PVC), polypropylene, polytetrafluoroethylene (PTFE), polyvinyl cyclohexane, poly(vinyl acetate) (PVA), polyisocyanatoethyl methacrylate (ICEMA), monosaccharide, disaccharide, or any combination thereof.

19. The method of claim 18, wherein said single chain polymer or copolymer is PMMA, PSMA, isoprene copolymer, PSMA-PAEMA or PMMA-PAEMA copolymer.

20. The method of claim 15, wherein said intramolecular crosslinked polymer is PMMA-PAEMA cross linked by trimethylolpropane triacrylate (TMT).

21. The method of claim 15, wherein said intramolecular crosslinked polymer is PSMA-PAEMA cross linked by trimethylolpropane triacrylate (TMT).

22. The method of claim 1, wherein said intramolecular crosslinked polymer is more resistant to mechanochemical scission compared to linear polymer with the same MW range in solution.

23. A method of reducing turbulence in flow of a liquid comprising adding to said liquid an intramolecular crosslinked polymer as a drag reducing agent, wherein said intramolecular crosslinked polymer comprises between 0.1 mol % and 30 mol % of crosslinkers which link between two different monomers of the same chain of said intramolecular crosslinked polymer.

24. The method of claim 23, wherein said liquid is water, oil or petroleum.

25. The method of claim 23, wherein said intramolecular crosslinked polymer comprises a single chain polymer or copolymer and said cross-linker, wherein the cross linker links between two different monomers of said single chain polymer or copolymer.

26. The method of claim 25, wherein said single chain polymer or copolymer comprises poly(aminoethyl methacrylate), poly(2-acetoxy)ethyl methacrylate (PAEMA), polystyrene, polyacrylic acid (PAA), polyalanine, polyester, polycarbonate, polyurea, polyurethane, vinyl polymers, polyalkyl, polyalkyl acrylate, polybutadiene, polyamide, PEG, polypropylene glycol, polyacrylamide, polyacrylonitrile (PAN), poly(2-cinnamoylethyl methacrylate) (PCMA), polyalkyl methacrylates, polyisobutene, polyisoprene, polychloroprene, poly(styrene-co-isoprene), polymethyl methacrylate (PMMA), polylauryl methacrylate, polystearyl methacrylate (PSMA), poly(vinyl chloride) (PVC), polypropylene, polytetrafluoroethylene (PTFE), polyvinyl cyclohexane, poly(vinyl acetate) (PVA), polyisocyanatoethyl methacrylate (ICEMA), monosaccharide, disaccharide, or any combination thereof.

27. The method of claim 26 wherein said single chain polymer or copolymer is PMMA, PSMA, isoprene copolymer, PSMA-PAEMA or PMMA-PAEMA copolymer.

28. The method of claim 24, wherein said intramolecular crosslinked polymer is PMMA-PAEMA cross linked by trimethylolpropane triacrylate (TMT).

29. The method of claim 24, wherein said intramolecular crosslinked polymer is PSMA-PAEMA cross linked by trimethylolpropane triacrylate (TMT).

30. The method of claim 24, wherein the single chain polymer or copolymer has MW of between 30 kg/mol and 15000 kg/mol.

31. The method of claim 23, wherein the concentration of said intramolecular cross linked polymer in said liquid is between 0.00001 wt % (0.1 ppm) and 1 wt %.

32. A method of preparing a lubricant composition, comprising the steps of: synthesis of intramolecular crosslinked polymer and adding said intramolecular crosslinked polymer to a base oil, thereby forming the lubricant composition.

33. The method of claim 32, wherein the intramolecular crosslinked polymer is prepared by (i) synthesis of linear chain polymer precursor from monomers; and (ii) crosslinking the linear chain polymer precursor to afford an intramolecular crosslinked polymer; or the intramolecular crosslinked polymer in one step.

34. The method of claim 33, wherein said monomers are aminoethyl methacrylate, (2-acetoxy)ethyl methacrylate, styrene, acrylic acid, alanine, ester, carbonate ester, urea, urethane, alkyls, alkyl acrylate, butadiene, amide, ethylene glycol, propylene glycol, acrylamide, acrylonitrile, 2-cinnamoylethyl methacrylate, alkyl methacrylates, isobutene, isoprene, chloroprene, styrene, isoprene, methyl methacrylate, lauryl methacrylate, stearyl methacrylate, vinyl chloride, propylene, tetrafluoroethylene, vinyl cyclohexane, vinyl acetate, isocyanatoethyl methacrylate, monosaccharide, disaccharide, or any combination thereof.

35. The method of claim 33, wherein said intramolecular crosslinked polymer is polymerized by the polymerization method of reversible-deactivation radical polymerization (RDRP), reversible addition-fragmentation chain-transfer polymerization (RAFT), atom transfer radical polymerization (ATRP), Single-Electron Transfer Living Radical Polymerization (SETLRP) or nitroxide-mediated polymerization (NMP).

36. The method of claim 35, wherein said polymerization method is reversible-deactivation radical polymerization (RDRP).

37. The method of claim 35, wherein said polymerization method is atom transfer radical polymerization (ATRP).

38. The method of claim 35, wherein said polymerization method is Single-Electron Transfer Living Radical Polymerization (SET-LRP).

39. The method of claim 35, wherein said polymerization method is reversible addition fragmentation chain-transfer polymerization (RAFT).

40. The method of claim 33, wherein said crosslinking comprises reacting said linear chain polymer precursor with a crosslinker.

41. The method of claim 40, wherein the crosslinker is trimethylolpropane triacrylate (TMT).

42. The method of claim 32, wherein said intramolecular crosslinked polymer is added, wherein concentration of said intramolecular cross linked polymer in said lubricant is between 0.001 wt % and 30 wt %.

* * * * *